United States Patent [19]

Tucker

[11] Patent Number: 4,869,148

[45] Date of Patent: Sep. 26, 1989

[54] LOADING DIE FOR AMMUNITION

[76] Inventor: David S. B. Tucker, 59 Edinburgh Terrace, Port Augusta, South Australia, Australia

[21] Appl. No.: 250,856

[22] Filed: Sep. 29, 1988

[51] Int. Cl.[4] ..... F42B 11/02; F42B 33/12

[52] U.S. Cl. ..... 86/43; 86/23; 86/25; 86/28; 86/39; 86/40

[58] Field of Search ..... 86/23, 24, 25, 28–31, 86/39, 40, 43

[56] References Cited

U.S. PATENT DOCUMENTS

| | | | |
|---|---|---|---|
| 1,933,940 | 11/1933 | Sutton | 86/28 |
| 2,600,488 | 6/1952 | Crump | 86/43 |
| 2,829,554 | 4/1958 | Sawyer | 86/43 |
| 3,200,695 | 8/1965 | Santomieri | 86/24 |
| 3,204,518 | 9/1965 | Jackson | 86/43 |
| 3,336,830 | 8/1967 | Lester, Jr. | 86/43 |
| 3,440,923 | 4/1969 | Purdie | 86/43 |
| 3,580,127 | 5/1971 | Lee | 86/24 |
| 4,189,980 | 2/1980 | Schaenzer | 86/43 |
| 4,248,132 | 2/1981 | Blomseth | 86/43 |
| 4,522,102 | 6/1985 | Pickens | 86/43 |
| 4,637,291 | 1/1987 | Alexander | 86/40 |

*Primary Examiner*—Howard J. Locker

*Attorney, Agent, or Firm*—Brown, Martin, Haller & McClain

[57] ABSTRACT

A loading die for use within an ammunition loading press that is designed for maximum accuracy. Whereas prior art loading dies are inaccurate due to angular and axial misalignment of the various die, ram and ammunition components, the invention has clearance between the sliding sleeves and the die body. The sliding sleeve locates accurately over the cartridge case and due to the clearance, any axial or angular misalignment between the sliding sleeve and die body will not affect the seating accuracy.

7 Claims, 6 Drawing Sheets

LOADING DIE FOR AMMUNITION

This invention relates to a loading die for ammunition, and in particular to improvements in relation to such dies so as to allow accurate seating of a projectile into a cartridge.

BACKGROUND OF THE INVENTION

It is well known amongst rifle and pistol enthusiasts that reloading by the enthusiast will result in cheaper ammunition. This requires the use of loading presses, amongst other equipment, to fit a projectile into a cartridge case.

Many such presses are known, and in the main they comprise a seat which holds the base of the cartridge in an upright position. This is necessary, since at this stage the cartridge normally contains the required charge of powder. A projectile is then placed onto the cartridge, or within a die such that the projectile is forced into the cartridge under movement of either a die or the seating arrangement which holds the cartridge.

Commonly, either a C-frame or O-frame press is used to hold the die assembly, and the cartridge is forced into the bore of the die wherein the bore of the die is closely shaped to the external surface of the cartridge, such that it is held firmly in position within the die. The projectile, which is located in a bore within the die above the cartridge, is held against the upper end of the cartridge by a seating stem which engages the upper portion of the projectile, and by movement of a ram from below the cartridge and by holding the seating stem stationary, and moving the cartridge upwardly, the projectile is forced into position in the cartridge.

In order to ensure the accuracy of ammunition, it is essential that the projectile be accurately positioned in the cartridge. Any angular misalignment of the projectile in relation to the cartridge will result in variations in the projectile trajectory once the ammunition is fired. In many circumstances of use of the ammunition, such as for sporting requirements, inaccuracies are tolerable. However, where the ammunition is being used for target shooting or any other accurate shooting, there is a requirement for the utmost accuracy in all equipment used. This includes the ammunition, and therefore great trouble is taken in relaton to correct alignment of the projectile in the cartridge.

Although there are many factors affecting the correct alignment of the projectile with respect to the cartridge such as sizing of the cartridge neck, tolerances of projectile diameter, and changes in the cartridge sizing due to repeated use, there are noticeable inaccuracies which result through misalignment of the loading die components.

In the common C-frame or O-frame press, where a ram moves a cartridge into a loading die, the loading die is secured within an upper arm of the press frame. As many different types of dies are commonly used in the one press, each loading die assembly is inserted into the upper arm by way of screw thread engagement. This, therefore, will result in both axial misalignment and angular misalignment of the loading die in relation to the ram of the loading die. Due to the sliding fits between the various components that comprise a loading die, such misalignment will result in eccentric forces being applied between the cartridge case and the projectile, which will then result in angular misalignment of the projectile in relation to the cartridge case.

In addition, although the forces involved in seating a projectile within a cartridge are relatively small, they are still sufficient to result in minute deflection of a C-frame press such that it slightly opens thereby resulting in further angular misalignment.

DESCRIPTION OF THE PRIOR ART

As mentioned, loading presses in general are well known. For example the press shown in U.S. Pat. No. 1,933,940 shows an example of the most basic type of loading press. In this press, it can be seen that the internal surfaces of the die are carefully shaped in relation to both the projectile and the cartridge case. The shoulders of the cartridge will finally seat against the die once the projectile is fully in position. However, therein lies the inaccuracy within this press, in that the projectile commences seating into the cartridge case before the shoulders are fully located within the die. Therefore, because the projectile starts seating into the cartridge case before the cartridge case is held in position, the projectile will, in most cases, commence seating with angular misalignment. This then results in ammunition that will provide an inaccurate trajectory.

In order to overcome the problems associated with the aforementioned loading press, U.S. Pat. No. 3,204,518 in the name of Jackson shows a loading press that has the cartridge shoulder seating within a die prior to the projectile seating in the cartridge. This invention shows a sliding die member in which the cartridge seats, and upon the cartridge seating and further upward movement from the ram, the projectile then seats into a projectile seating stem. Upon still further upward movement, the projectile seating stem abuts against an upper stop, and the projectile which commences projectile location within the cartridge.

However, such an arrangement still results in angular misalignment between the projectile and the cartridge case, since there is no way of controlling the axial and angular misalignment between the ram which holds the cartridge case, and the upper die members which restrain the projectile for engagement within the cartridge case. Such misalignment will result in eccentric forces being applied to the upper end of the projectile, which then results in the poor seating of the projectile in the cartridge case.

Further relevant prior art is U.S. patent application No. 3,440,923 in the name of Purdi which shows a loading die having components that slide in relation to one another, requiring high tolerance fit. Although the loading die is not fixed to the press frame, in operation this frame will still have problems of misalignment between the die components and the cartridge and projectile.

Therefore, it is an object of this invention to overcome the abovementioned deficiencies of prior art and produce a loading die for use in a press that enables more accurate alignment and seating between a projectile and a cartridge case.

It is a further object of this invention to provide a loading die for accurately seating a projectile within a cartridge case that is relatively simple and easy to manufacture or use.

BRIEF DESCRIPTION OF THE INVENTION

In its broadest form, a loading die for use in combination with a cartridge loading press for the loading of a projectile into a cartridge comprises a sliding sleeve having walls defining a bore therethrough, a first portion of said bore having walls shaped so as to locate a cartridge case therein, the second portion of said bore thereafter having a diameter allowing a sliding fit with respect to a projectile, a projectile seating stem slidaby located within the sliding sleeve, one end of said seating stem having projectile engagement means, and a die body adapted for positioning in a loading press having walls defining a bore for location of the sliding sleeve therein, and an end surface against which the projectile seating stem may locate, said die body bore having a clearance fit with respect to said sliding sleeve.

The prior art loading dies, have a sliding fit provided between the sliding sleeve which locates the cartridge case and the die body. Therefore, with the inaccuracies resulting from very coarse threads on the outer surface of the outer die body which are used to locate the die body within the press frame, it is very difficult to ensure alignment between the ram and the sliding sleeve. Obviously, there needs to be a clearance between mating threads so that they allow for easy location of the die body within the frame press, and as such this will result in an inaccuracy of alignment of the sliding sleeve with relation to the ram. In addition to this inaccuracy, there will also be a lack of concentricity between the outer surface of the die body, and the bore therethrough which contains the sliding sleeve.

Therefore, in accordance with the above description of the invention, there is provided a clearance fit between the die body and the sliding sleeve which locates the cartridge case. Once the sliding sleeve is securely fixed over the cartridge case, due to the clearance provided, the sliding sleeve will not be constrained in any way by the die body bore, and its position will only depend upon the cartridge case position. If there is any misalignment between the axial position of the die body, and the axial position of the ram, the clearance between the sliding sleeve and the die body will enable the sliding sleeve to accurately position itself over the cartridge case.

In use, the projectile is placed within the sliding sleeve prior to positioning of the cartridge case. However, seating of the projectile does not occur until the cartridge case is fully located within the sliding sleeve, and upon continued upward motion of the sliding sleeve, the upper end of the projectile seating stem will engage against the end surface of the die body. This will then result in the projectile being forced into the cartridge case. With clearance between the die body and the sliding sleeve, and because of the possible angular misalignment between the die body and the sliding sleeve, it is preferable that the upper end of the seating stem be convex, such that no bending moments or eccentric forces results.

Those components of the invention which require accurate alignment are the projectile seating stem and its fit within the sliding sleeve, the positioning of the projectile engagement means within the center of the seating stem, and alignment of the bore into which the seating stem locates with the recess which is shaped to fit the cartridge case. The accurate fitment and construction of each of these components is readily achieved using normal machining processes, particularly the sliding fit between the seating stem and sliding sleeve. This fit should be either a close sliding fit or a sliding fit, such that there is no perceptible play between the seating stem and the sliding sleeve.

The accurate alignment of the seating stem inside the sleeve is further improved by the seating stem having a relatively large length located within the sliding sleeve both at commencement of the projectile seating. Preferably, a third of the seating stem length should be inserted within the sliding sleeve at commencement of projectile seating, and the length of the seating stem should be preferably at least three times greater than the seating stem diameter. Obviously, when only a small portion of the seating stem is located within the sliding sleeve, it allows for a greater angular misalignment than with a larger portion of the seating stem positioned within the sliding sleeve bore.

Preferably, the upper ends of both the seating stem and the sliding sleeve are provided with a circumferential ridge which either comprises a continuous ridge, or a series of projections around the circumference of either component. In the case of the sliding sleeve, the ridge abuts against the upper end of the die body, so that the sliding sleeve is suspended in relation to the die body prior to insertion of the cartridge case. Likewise, the ridge on the upper end of the seating stem also suspends the seating stem in relation to the sliding sleeve. Apart from holding both the sliding sleeve and the seating stem in relation to the die body prior to seating of a projectile within a cartridge case, it also allows the assembled cartridge and projectile to be withdrawn from the loading die after the loading operation.

In order to allow for fine adjustment of the depth to which the projectile is inserted into the cartridge case, the upper end of the die body may comprise a cap, wherein the inner horizontal surface of the cap forms the end surface against which the seating stem abuts during the loading operation. The cap in turn is threadably engageable to the upper end of the die body, and a graduated scale is provided on the outer surface of the die body so that the position of the cap can be accurately determined.

In addition, it is preferable that the convex end of the seating stem, and the end surface against which this end abuts are both hardened and polished. The hardening of the components prevents premature wear and pitting of the various components, and enables purely axial forces to be applied to the projectile regardless of the misalignment between the sliding sleeve and die body.

In addition to the loading of cartridges, it will be recognized that the loading die subject of this invention will be equally useful in relation to reloading of cartridges. In such cases, the cartridges after being used require resizing of the shoulder and projectile seating portion, and there are many tools which are useful for such resizing purposes. However, it will be recognized that the accuracy of any loading die will also depend upon the quality and accuracy of the projectiles and cartridge cases used.

BRIEF DESCRIPTION OF THE DRAWINGS

A description of a preferred embodiment follows, and it will be understood by those skilled in the art that various other modifications and changes may be made to the present invention from the principles of the invention described in the preferred embodiment without departing from the spirit and scope thereof. The preferred embodiment is illustrated in the accompanying representations where;

FIG. 1 shows a loading press 10 with a loading die 11 located therein. The loading die 11 is installed within a C-frame member 12 and is positioned above the ram 13.

Figure 1:
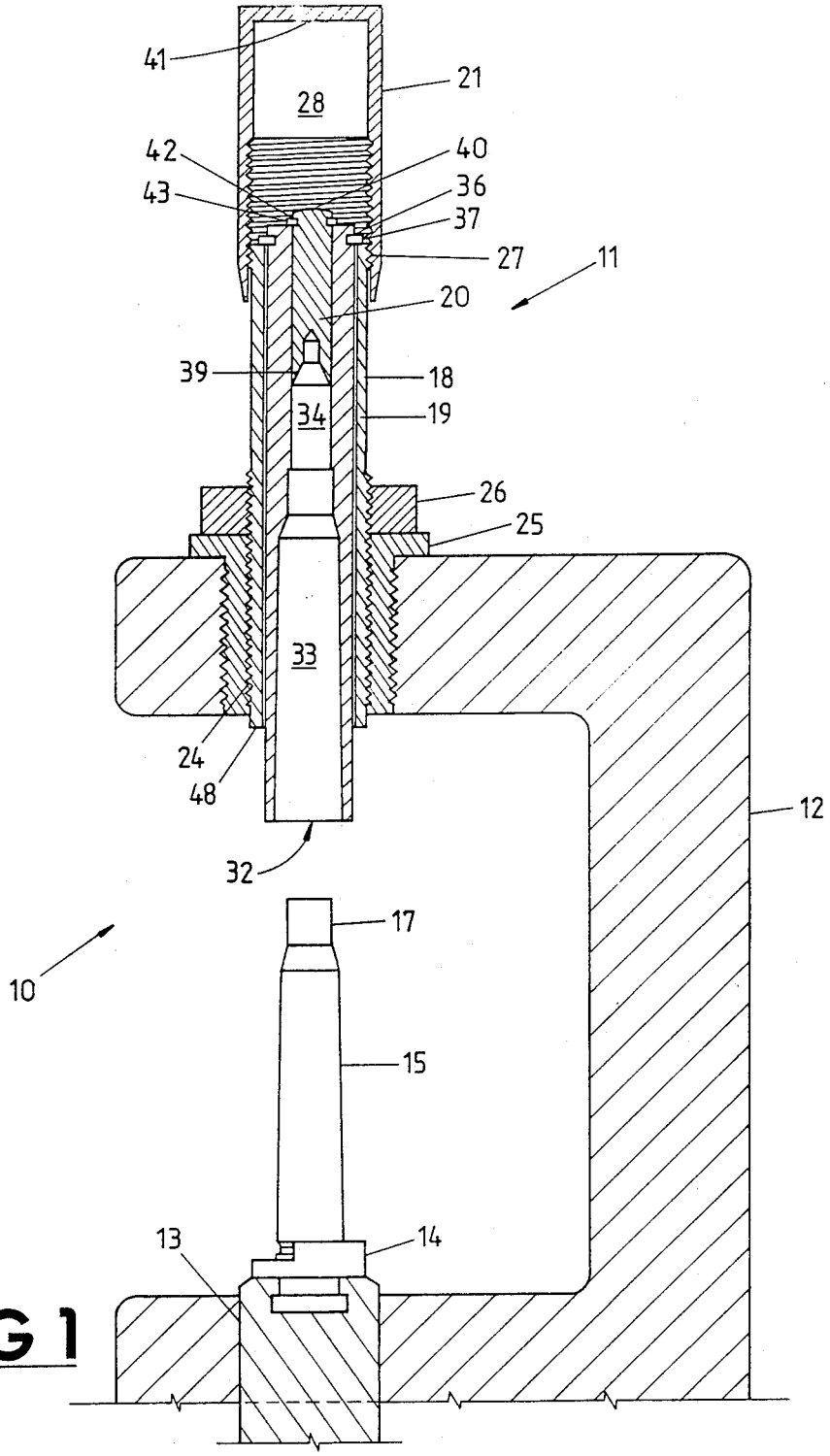
FIG. 1 shows a cross-sectioned view of a loading die inserted within a C-frame press.

The ram 13 is moved by way of either a lever system, pneumatic operators, or hydraulic operators. Such operating mechanisms for the ram 13 are well known, and in particular a preferred version is shown in U.S. Pat. No. 2,847,895. The upper portion of the ram 13 has a cartridge holder 14 which has recesses specifically designed to releasably locate the base of the cartridge 15 therein. The cartridge holder 14 is well known, and commonly used in such sliding presses.

The loading die 11 comprises a die body 18, a sliding sleeve 19 and a projectile seating stem 20. In this embodiment, there is also provided a die cap 21 which is threadably engaged to the upper end of the die body 18.

The lower end of the die body 18 is provided with an external thread 24 which is engageable with a collar 25. The collar 25 is in turn threadably located within the C-frame 12, and a lock ring 26 secures both the die body 18 and the collar 25 within the loading press.

Figure 2:
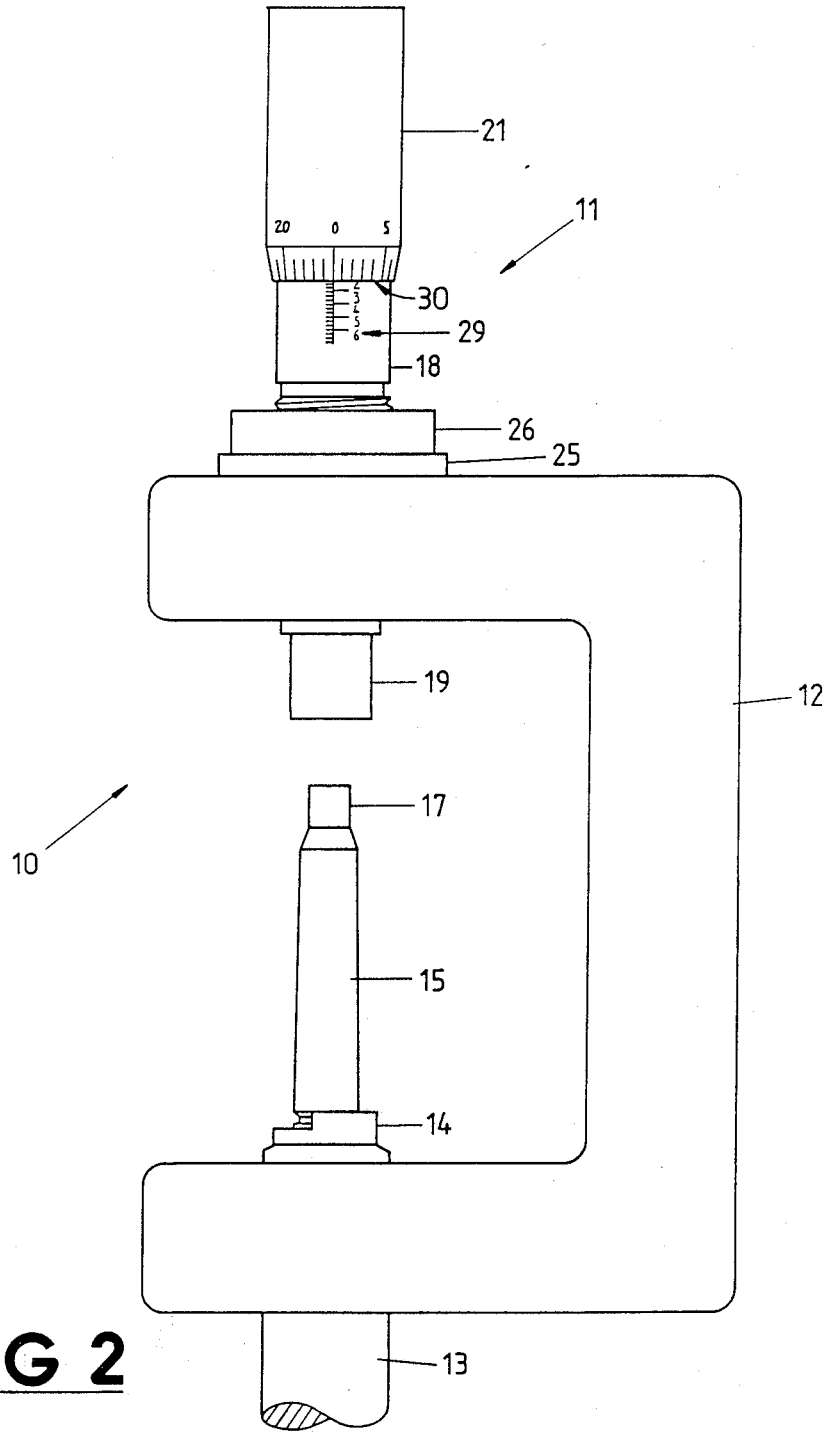
FIG. 2 shows a side elevation view of the loading die inserted within a C-frame press.

The upper end of the die body 18 is provided with a further external thread 27 and the die cap 21 is provided with a corresponding thread on the internal wall surface 28 of the cap 21. As can be seen in FIG. 2 the external surface of the die body 18, and the lower edge of the die cap 21 are provided with graduated scales 29 and 30 which allow for accurate adjustments of the depth to which the projectile is inserted into the cartridge case 15. In this embodiment the external thread 24 on the die body 18 is a coarse thread and the external thread 27 on the upper portion of the die body is a fine thread. The fine thread provides only minimal movement of the cap 21 for each rotation of the cap 21, whereas the coarse thread is the standard thread used with such loading dies.

The sliding sleeve 19 which locates within the die body 18, is provided with a bore 32 that extends through the length of the sliding sleeve 19. The lower portion of the bore 33 has walls which are shaped so as to locate a cartridge case therein. As can be seen from the illustrations, the lower portion of the bore 33 is shaped so as to precisely locate the cartridge case 15 therein. Apart from the neck of the cartridge 15, the shoulder and remaining portion of the cartridge body are tapered, and therefore once the cartridge case is in position, there will be absolutely no play between the cartridge 15 and the sliding sleeve 19. The machining process to form the lower bore 33 is relatively straightforward since reams are provided to each type of cartridge which will precisely produce the required bore.

The upper portion 34 of the bore 32 has a diameter that precisely locates the projectile 16 therein. The fit between the upper portion of the bore 34 and the projectile 16 is such that there is no perceptible play within the bore 34. The diameter of this bore, since it conforms to the projectile 16 will be slightly less than the diameter of the neck of the cartridge 15. This is to take into account the metal thickness of the cartridge neck 17. It is most important that the upper bore 34 be perfectly concentric with the lower bore 33. This is easily achieved in the machining operation where the first hole drilled through the entire length of the sliding sleeve has the same diameter as the upper bore 34. Subsequent machining operations on the lower portion of the bore 33 will result in a cartridge chamber concentric to the upper bore.

The external diameter of the sliding sleeve 19 in relation to the internal diameter of the die body is such that a clearance fit results when the two components are assembled.

It has been found that a clearance of 1mm is adequate for correct operation of the loading die 11. However, smaller clearances may be quite adequate, provided that any angular or axial misalignment does not result in the external surface of the sliding sleeve 19 abutting against the internal surface of the die body 18.

The upper end of the sliding sleeve 19 is provided with a peripheral ridge which abuts against the upper end of the die body 18. In this embodiment, the sliding sleeve 19 is provided with an annular groove 36 into which a ring clip 37 locates. The ring clip 37 in turn abuts against the upper edge of the die body 18. The ring clip 37 thereby prevents the sliding sleeve 19 from falling through the die body 18, and also enables the ram to pull the cartridge case 15 out of the lower bore 33 once the loading operation is completed.

The projectile seating stem 20 which locates in the upper bore 34 of the sliding sleeve 19 has at its lower end a projectile engagement means which comprises a recess 39. The upper end of the seating stem 20 is provided with a convex surface 40. In the loading operation, the upper end of the projectile 16 locates within the recess 39, and the convex end 40 of the seating stem 20 locates against the end surface 41 of the die cap 21. If the upper end of the seating stem 20 is flat, and if there was any angular misalignment of the sliding sleeve 19, then the flat surface of such a seating stem would result in an eccentric force which would result in a bending moment between the seating stem 20 and the sliding sleeve 19, which would result in further inaccurate placement of the projectile 16 within the cartridge case 15. However, it is preferable to have a convex surface 40, so that no such additional bending moment is produced, and the force applied to the seating stem 20 by the end surface 41 is still as close as possible to the centre of the seating stem 20. This therefore results in a more accurate placement of the projectile 16 within the cartridge case 15.

The upper end of the seating stem 20 is also provided with an annular groove 42 and a ring clip 43. This enables the seating stem 20 to be suspended from the sliding sleeve 19, as the ring clip 43 abuts against the upper edge of the sliding sleeve 19. This also aids withdrawing the loaded ammunition from the loading die 11.

Figure 7:
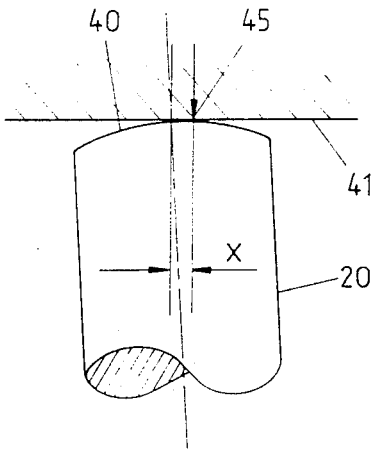
FIG. 7 and FIG. 8 show a comparison between the use of a seating stem with a convex end and a flat end, showing the degree of eccentricity of the applied force as represented by the dimension X.
Figure 8:
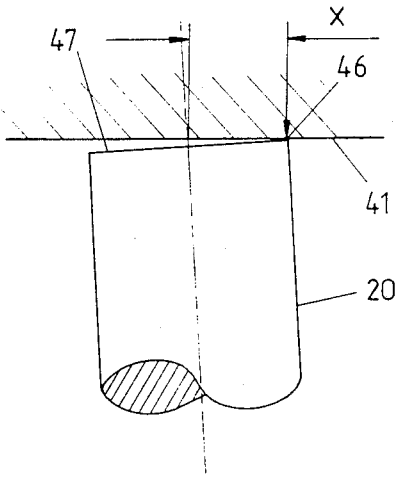

FIG. 7 and FIG. 8 show a comparison between an upper end of the seating stem 20 having, as shown in FIG. 7, a concave surface and, as shown in FIG. 8, a flat surface. The seating stems 20 are shown with an exagerated angular misalignment, but it will be seen that in FIG. 7 the distance between the point of contact 45 and the center line of the seating stem 20, designated as "X" will remain small. By comparison as shown in FIG. 8 the distance between the point of contact 46 on a seating stem 20 having a flat upper surface and the center line of that seating stem 20 will be much greater, an in fact regardless of the degree of angular misalignment, will always be the same distance. This is due to the fact that with any angular misalignment, it will always be the outer edge of the seating stem 20 which will first locate the end surface 41. Therefore, with minimal angular misalignment, the distance X of a seating stem 20 having a convex end 40 will be very small, whereas the corresponding distance on a flat surface seating stem 20 will remain constant. As a result the eccentric forces on a flat surfaced seating stem 20 will be greater, which will result in seating of the projectile 16 that does not have as high a degree of accuracy.

Figure 3:
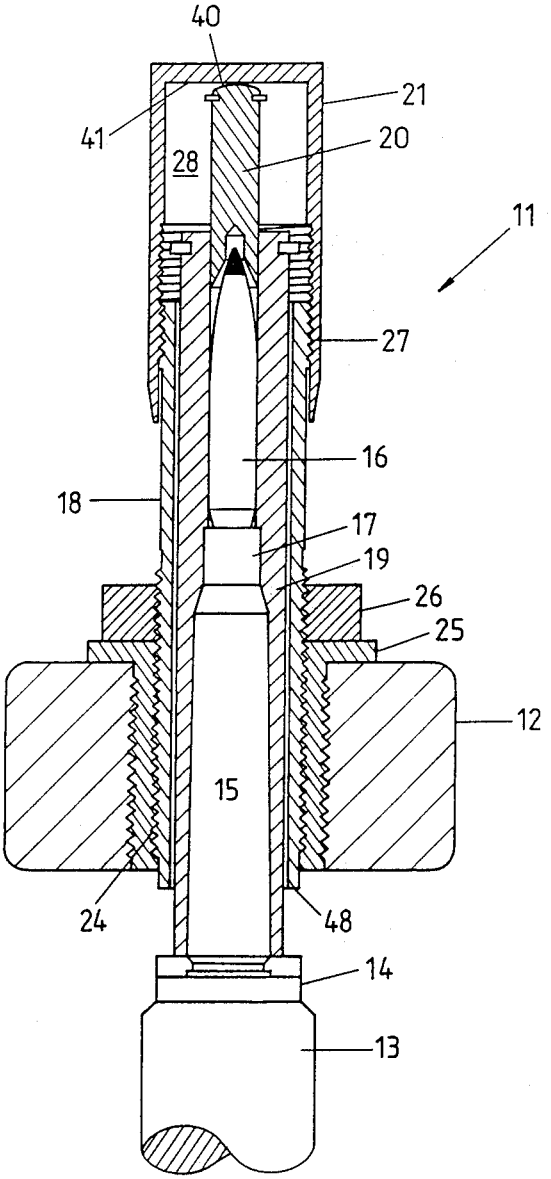
FIG. 3 shows a part cross-sectioned view of a loading die with a cartridge and projectile located fully within the sliding sleeve, with the seating stem located against the die cap just prior to the projectile commencing seating into the cartridge case.

The operation of the loading die first comprises placing a cartridge 15, having the necessary power charge, within the cartridge holder 14. A projectile 16 is then balanced on top of the cartridge 15, and the cartridge 15 is raised into the bore 33 by operation of the ram 13. As shown in FIG. 3, prior to the seating of the projectile 16 within the cartridge 15, the cartridge 15 will be totally located within the lower bore 33, the projectile will be seating on the neck 17 of the cartridge, and the projectile will be located within the recess 39 of the seating stem 20. In addition, the seating stem will be raised within the upper bore 34 of the sliding stem 19, and the upper end 40 of the seating stem 20 will be abutting against the end surface 41 of the die cap 21.

In this position, at least one third of the length of the seating stem 20 is located within the upper bore 34. Although the fit between the upper bore 34 and the seating stem 20 is a close running fit, by having at least one third of the length of the seating stem 20 located therein, it will reduce the angular misalignment of the seating stem 20 given what clearance there might actually be.

Figure 4:
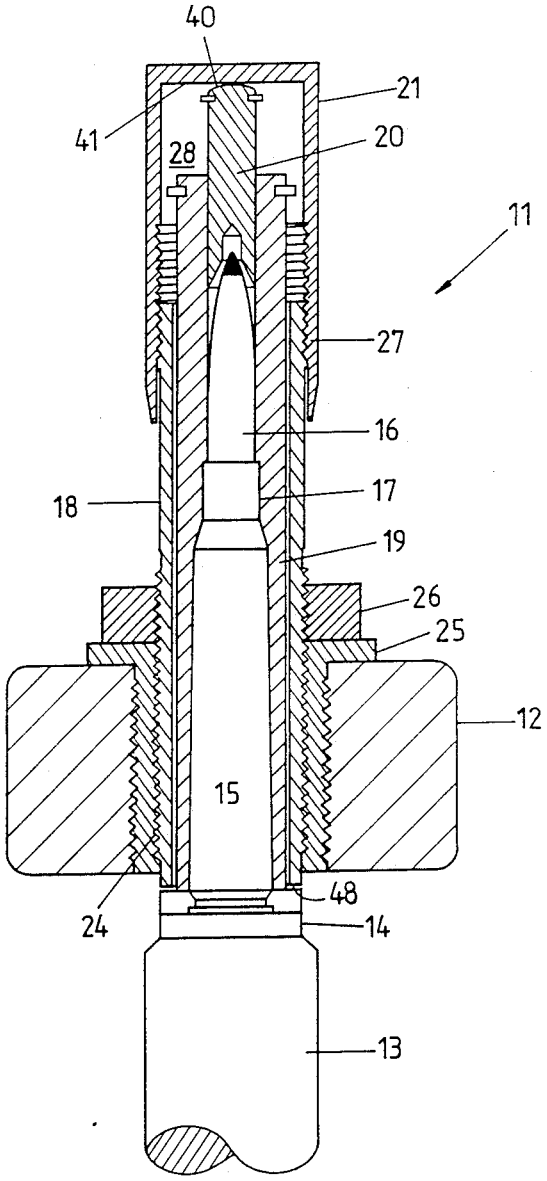
FIG. 4 shows a part cross-sectioned view of a loading die installed within a C-frame press wherein the projectile is fully seated within the cartridge case.

At the point shown in FIG. 3, the projectile 16 is at the point of commencing its seating into the cartridge 15. Upon continued upward movement of the ram 13, the projectile 16 will commence to seat into the cartridge case 15, until as shown in FIG. 4 the full upward movement of the ram is completed. At this point the projectile 16 is then fully seated within the cartridge 15.

Once the loading operation is complete, the ram 13 is then withdrawn, and upon lowering the sliding sleeve 19, the ring clip 37 abuts against the upper surface of the die body 18, and the loaded cartridge is then withdrawn from the lower bore 33. Likewise, the projectile is extracted from the recess 39 by the ring clip 43 abutting against the upper surface of the sliding sleeve 19.

Figure 5:
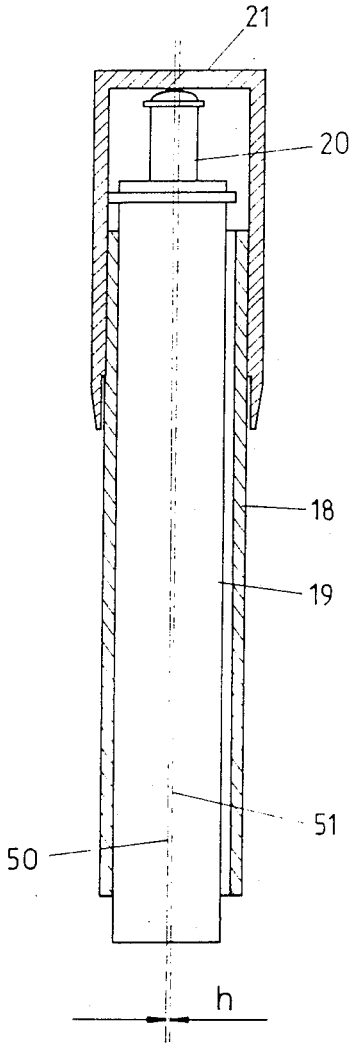
FIG. 5 shows a schematic representation of the die body in cross-section with a sliding sleeve located therein, wherein the sliding sleeve is axially misaligned as shown by the dimension h.
Figure 6:
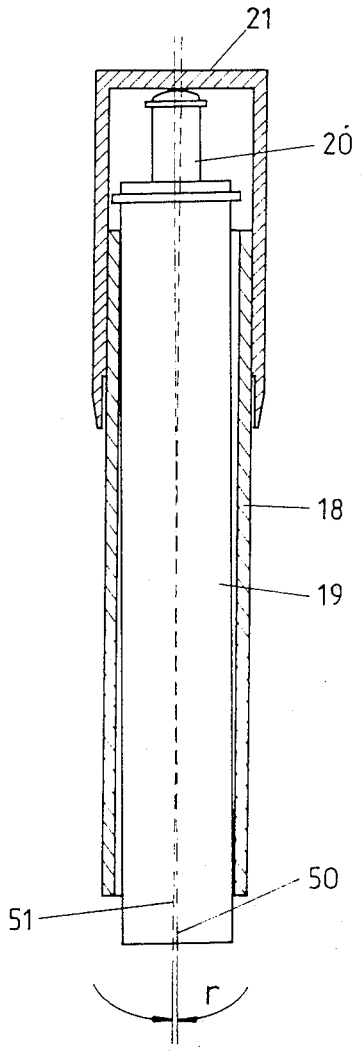
FIG. 6 shows a schematic representation of the loading die with the die body in cross-section and the sliding sleeve located therein, wherein the sliding sleeve is angularly misaligned as shown by the dimension r.

FIG. 5 and FIG. 6 show schematically axial misalignment and angular misalignment respectively. As can be seen in FIG. 5, if there is any axial misalignment represented by the dimension h between the axis that extends through the cartridge case and ram and the axis of the loading die 11 then the clearance between the sliding sleeve 19 and the internal bore of the die body 18 will allow the sliding sleeve 19 to adjust its position within the die body 18. This adjustment will obviously occur without any force being applied to the sliding sleeve 19 which would normally occur if there was a sliding fit between these components. As shown in FIG. 6, if there is any angular misalignment, represented by the dimension r, between the sliding sleeve 19 and the die body 18, the clearance existing between these components will enable the sliding sleeve to adjust to this misalignment without any further eccentric forces being applied during the seating process. As can be seen both in FIG. 5 and FIG. 6, regardless of the misalignment, the arrangement will still enable perfect alignment between the cartridge case and the projectile, and the application of axial forces to the seating stem 20 which will result in accurate seating of the projectile 16.

A person skilled in the art will readily recognise that the loading die will be equally suitable to various shapes of cartridges, that may be used in either rifles or pistols. Additionally, the loading die will be equally suitable in mass production operations as well as the hand operated presses.

I claim:

1. A loading die for use in combination with a cartridge loading press for the loading of a projectile into a cartridge, comprising:

a sliding sleeve having a bore therethrough, a first lower portion of said bore comprising means for locating the cartridge case, a second upper portion of said bore comprising means for allowing a sliding fit with respect to a projectile;

a projectile seating stem slidably located within the upper portion of the sliding sleeve bore, the lower end of said stem having projectile engagement means for engaging the upper end of a projectile in said bore, and a die body having means for positioning said die body in a loading press, the die body having an axially extending bore comprising means for slidably locating the sliding sleeve therein with a clearance between the outer surface of the sleeve and the inner surface of said bore, and a locating end surface comprising means for locating the projectile seating stem.

2. A loading die according to claim 1 wherein the upper end of the seating stem has a convex surface.

3. A loading die according to claim 2 wherein the length of said seating stem is at least three times greater than its diameter.

4. A loading die according to claim 3 wherein at least one third of the length of said seating stem is located within said second portion of the sliding sleeve bore prior to the projectile starting to locate within the cartridge.

5. A loading die according to claim 4 wherein the upper end of said sliding sleeve has a circumferential ridge for abutment on the upper end of said die body, and the upper end of said seating stem has a circumferential ridge for abutment on the upper end of said sliding sleeve.

6. A loading die according to claim 5 wherein said end surface further comprises an inner surface of a cap that is threadably engageable to the respective end of said die body, the position of said cap being adjustable so as to allow for variations in the depth to which the projectile is inserted within the cartridge, a graduated scale being provided on the external surface of said die body and cap for use in relation to positioning of said cap.

7. A loading die according to claim 6 wherein said end surface and convex end of seating stem are hardened and polished.

* * * * *